United States Patent [19]

Garcia

[11] 4,222,524

[45] Sep. 16, 1980

[54] SHOWER HEAD MIXER

[76] Inventor: Robert Garcia, 1 Sadore La., Yonkers, N.Y. 10710

[21] Appl. No.: 27,978

[22] Filed: Apr. 9, 1979

Related U.S. Application Data

[63] Continuation-in-part of Ser. No. 872,903, Jan. 27, 1978, abandoned.

[51] Int. Cl.[3] ..... B05B 7/26

[52] U.S. Cl. ..... 239/315; 137/268; 422/255; 138/37

[58] Field of Search ..... 137/268, 205.5; 422/255, 261, 274, 275, 276; 239/310, 316, 315; 138/37, 38

[56] References Cited

U.S. PATENT DOCUMENTS

| | | | |
|---|---|---|---|
| 1,350,175 | 8/1920 | O'Connor | 137/268 X |
| 2,014,037 | 9/1935 | Burkett | 137/205.5 |
| 2,199,478 | 5/1940 | Brugand | 239/316 X |
| 2,604,446 | 7/1952 | Palmer | 137/268 X |
| 3,162,427 | 12/1964 | Knudson | 239/310 X |
| 3,195,985 | 7/1965 | Elkin | 239/310 X |

*Primary Examiner*—Alan Cohan
*Attorney, Agent, or Firm*—Robert D. Farkas

[57] ABSTRACT

A mixer chamber is connected in series with the outlet pipe of a shower head to reduce water temperature variations in the outlet water, dispensed at the shower head, due to temperature variations in the water supply. The chamber includes an inlet pipe having a plurality of small holes to provide a uniform spray to mix with the contents of the chamber. An outlet pipe connects the mixture from the chamber to the shower head. The chamber is in the form of a cylindrical container with the pipes connected to diametrically opposed sides and has removable end caps to provide access to the interior. A hollow cup-like device is installed within the chamber, having the interior portions thereof coupled to the outlet pipe. The cup-like shaped device is provided with a plurality of openings, on the outermost exterior surface thereof, thereby permitting water, entering through the inlet pipe, to be stored within the cup-like device and to act as a buffer against temperature changes in the water provided to the inlet pipe.

8 Claims, 2 Drawing Figures

SHOWER HEAD MIXER

This is a continuation-in-part application of now abandoned application, Ser. No. 872,903, filed Jan. 27, 1978 and now abandoned.

BACKGROUND OF THE INVENTION

1. Field of the Invention

The present invention relates to mixing chambers and particularly to a chamber connected to a shower head to provide more uniform water temperature distribution and to mix with and dispense the contents of the chamber.

2. Description of the Prior Art

Presently available mixing chambers for shower heads are connected in parallel with the water line by a single outlet or by a double line having an inlet at one end and an outlet at the other end. Examples of such devices are found in U.S. Pat. No. 3,352,320, issued Nov. 14, 1967 and U.S. Pat. No. 2,602,699, issued July 8, 1952. Other devices are known which employ on apertured pipe as a spray nozzle, such as shown in U.S. Pat. No. 1,837,136, issued Dec. 15, 1931. The apertured pipes are not used for mixing, and the chambers require special plumbing connections.

SUMMARY OF THE INVENTION

It is therefore the primary object of the present invention to provide a simple easily connected mixing chamber in series with the outlet pipe of a shower head.

Another object of the present invention is to provide a mixing chamber which acts as a buffer and temperature stabilizer, buffering input temperature variations so as to provide a more uniform temperature in the output portions of the device.

This is accomplished by a cylindrical mixing chamber having an apertured inlet pipe connected in series with the supply line of a shower head and extending into the chamber. An outlet pipe at the opposite surface of the chamber connects to the shower head. The aperture pipe provides a spray within the chamber to mix uniformly with the contents. This reduces water temperature variations and evenly dispenses the contents of the chamber. Removable end caps on the chamber provide access to insert various materials. An interior cup-shaped device, having a plurality of openings in the exterior surface thereof, has its interior cavity hydraulically coupled to the outlet pipe. Thus, the major storage area of the device, located within the interior of the cup-like structure, stores a quantity of water, such quantity of water being in thermal contact with the hollow walled cup. The exterior surface of the cup-like device also communicates with the balance of the interior of the chamber thereby allowing the water within the walls of the cup-like device to always contact the inlet source of water, acting as a temperature stabilizer thereby. Similarly, the exterior of the cup-like device, thermally communicating with the balance of the interior of the chamber, in turn communicating with the water that exits the inlet pipe acts as another thermal area of contact between the water within the walls of the cup-like device and the inlet water. Both broad areas of the cup-like device tend to rapidly effect the temperature of the water within the walls of such device thereby effectively eliminating transient excursions in temperature of the water flowing outwardly of the entire apparatus. Other objects and advantages will become apparent from the following description in conjunction with the accompanying drawings.

DESCRIPTION OF THE PREFERRED EMBODIMENT

Figure 1:
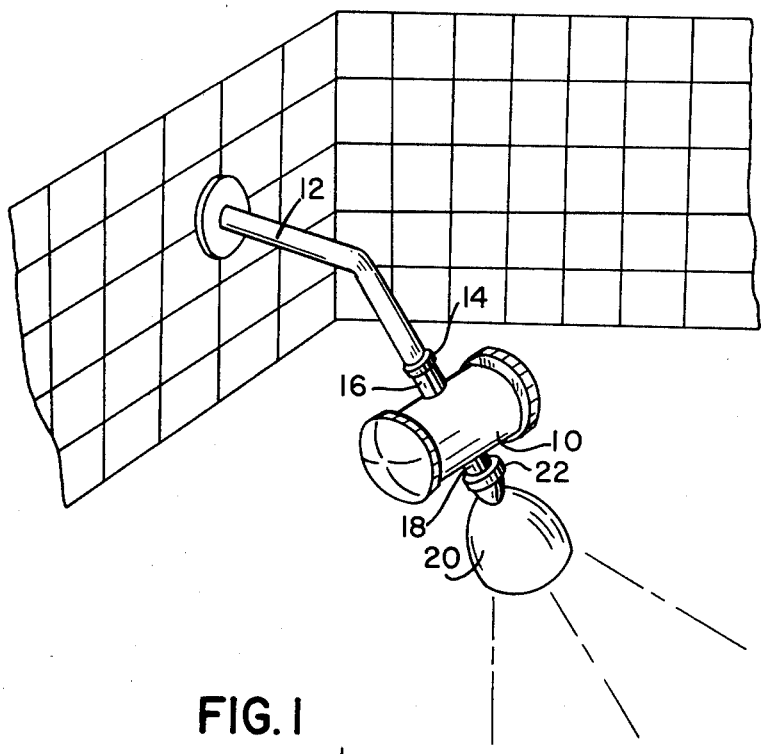
FIG. 1 shows the mixing chamber connected between the water supply line and the shower head, and, FIG. 2 is a cross-sectional view of the mixing chamber showing the apertured inlet pipe and the hollow cup-like shaped device.
Figure 2:
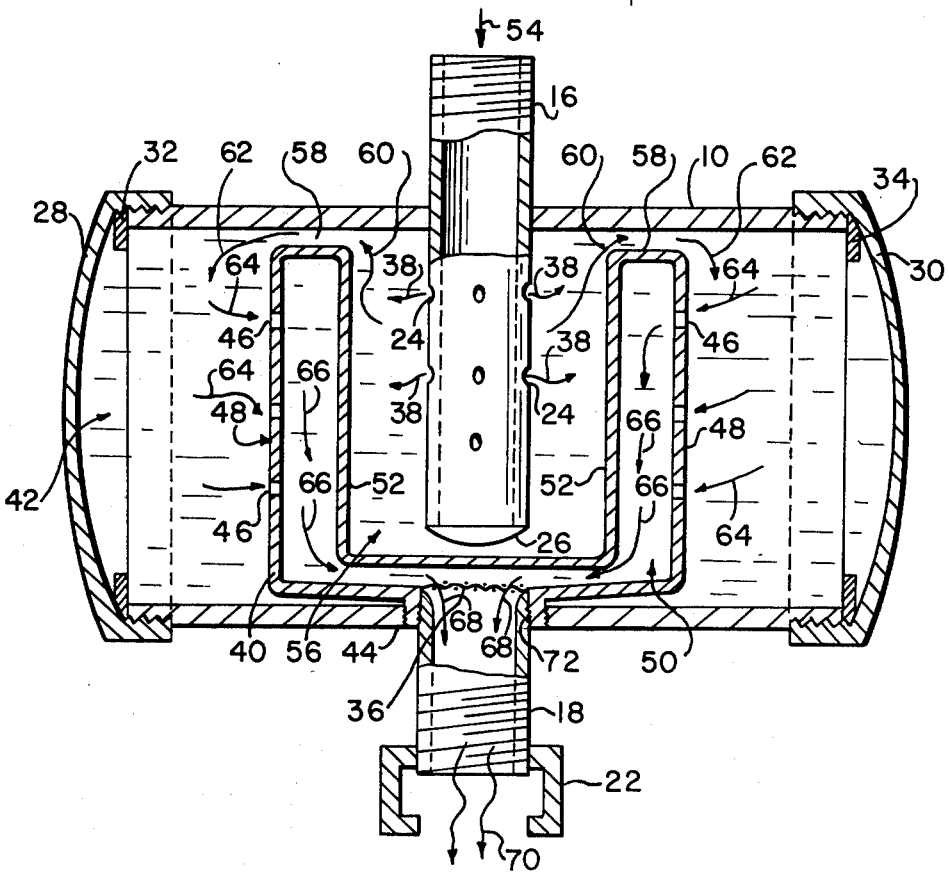

As shown in FIGS. 1 and 2, a cylindrical mixing chamber 10 is connected in series with the water supply pipe 12, by a female coupling 14 on the end of pipe 12, which screws onto the threaded end of inlet pipe 16. An outlet pipe 18, on the opposite surface of the chamber is connected to the shower head 20 by another female coupling 22 on the end of pipe 18.

Inlet pipe 16 is welded to the cylindrical chamber 10 on one surface and extends within the interior to a point adjacent the opposite surface. The interior section of pipe 16 includes a plurality of apertures 24 which provide a fine spray of water into the interior of the chamber. The inner end of pipe 16 has a cap 26 so that all the water flows out of side apertures 24, in the direction of arrows 38. Hollow cup-like device 40, shown installed within the interior space 42, of chamber 10, is shown threadingly engaged to outlet pipe 18, utilizing threads 72 therefor, as well as threads 44, utilized to secure cup-like device 40 to chamber 10. Threaded end caps 28 and 30 are screwed on to opposite sides of the chamber, providing ready access to the interior of such chamber for cleaning and other purposes. Washers 32 and 34 provide water tight seals for the end caps. A fine screen filter 36 is installed over the outlet pipe 18, within the chamber, to prevent any extraneous particles or other materials from washing out into shower head 20. It should be noted that soap, detergents, and other additives may be introduced within interior portion 42, by the simple expedient of removing either of end caps 28 or 30, if desired. If this is done, such additive will ultimately be dispensed outwardly through shower head 20.

The inlet and outlet pipes may typically be about $\frac{1}{2}$ inch iron pipe size, with the inlet apertures being about $\frac{1}{8}$ inch in diameter. The chamber may be about 4 inches in diameter and can be made of chrome-plated copper tubing or from plastic pipe.

Cup-like device 40 is provided with a plurality of apertures 46 on exterior surface 48 thereof. Cup-like device 40 is provided having a hollow interior 50, bounded by exterior surface 48 and interior surface 52. Hollow interior 50 is shown coupled to the interior of pipe 18.

Water, entering pipe 16, in the direction of arrow 54 leaves pipe 16, in the direction of arrows 38, by passing through apertures 24. The interior cavity 56, defined by walls 52, comprise a small interior reservoir in which water may accumulate. When the level of such water reaches the topmost region 58, of cup-like device 40, such water flows in the direction of arrows 60 and 62, spilling over the top of cup-like device 40 into interior portion 42. Water residing in interior portion 42 is in thermal contact with surface 48. Some of such water, flowing in the direction of arrows 64 enters apertures 46, so as to reside within hollow interior 50. Whilst in hollow interior 50, the water is thermally coupled to surfaces 48 and 52, causing such water, generally a small amount, to be stabilized in temperature by its thermal communication with the larger amounts of water contained within interior cavity 56 and interior portion 42.

Water contained within hollow interior 50, moving in the direction of arrows 66, and eventually flowing in the direction of arrows 68, passing through screen 36, enter the interior of pipe 18 so as to exit therefrom, in the direction of arrows 70.

One of the advantages of the present invention is to provide a simple easily connected mixing chamber in series with the outlet pipe of a shower head.

Another advantage of the present invention is to provide a mixing chamber which acts as a buffer and temperature stabilizer, buffering input temperature variations so as to provide a more uniform temperature in the output portions of the device.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A liquid mixing device comprising a mixing chamber, an inlet pipe, one end of said inlet pipe adapted for connection to a source of liquid, the other end of said inlet pipe passing through an opening located on one side of said chamber, said other end of said inlet pipe fixedly secured to the wall of said chamber so as to form a waterproof opening adjacent said opening, said other end of said inlet pipe having a first plurality of apertures for spraying said liquid within said chamber, said first plurality of apertures being located in a portion of the length of said inlet pipe adjacent said other end thereof and within said chamber, said portion of said inlet pipe extending normal to said one side of said chamber, said plurality of apertures for spraying said liquid only normally outwardly from the longitudinal axis of said portion of said inlet pipe, an outlet pipe, one end of said outlet pipe fluidly communicating to another side of said chamber, the other end of said outlet pipe being adapted for connection to a utilization device, said inlet pipe and said outlet pipe being coaxially aligned, said one end of said outlet pipe fixedly secured to said wall of said chamber so as to form another waterproof opening, said one end of said outlet pipe being substantially aligned with said wall defining said chamber, a hollow cup-like device, said hollow cup-like device defining a cavity therewithin, said cup-like device being secured within the interior of said chamber, said cavity being fluidly coupled to said one end of said outlet pipe, said hollow cup-like device having interior walls and exterior walls defining said cavity, said exterior walls of said hollow cup-like device having a second plurality of apertures therein, a portion of said portion of the length of said inlet pipe being disposed within said cavity of said hollow cup-like device.

2. The apparatus as claimed in claim 1 wherein said chamber is a hollow cylinder, the longitudinal axis of said portion of said inlet pipe being disposed extending normally to the longitudinal axis of said cylinder.

3. The apparatus as claimed in claim 2 further comprising a cap, said cap threadingly secured to one end of said cylinder, means to secure said cap to said cylinder in a water tight fashion.

4. The apparatus as claimed in claim 1 further comprising a filter, said filter being disposed adjacent said one end of said outlet pipe and located within said chamber.

5. The apparatus as claimed in claim 1 further comprising a solid cap, said solid cap being secured to said other end of said inlet pipe and being disposed centrally within said cavity of said hollow cup-like device, said first plurality of apertures being located in the wall of said inlet pipe and in opposed relationship with the adjacent surfaces of said interior walls of said hollow cup-like device.

6. The apparatus as claimed in claim 1 wherein said utilization device is a shower head, said chamber being serially connected between said source of liquid and said shower head.

7. The apparatus as claimed in claim 6 wherein said cavity of said hollow cup-like device are serially connected between said portion of said portion of said inlet pipe and said one end of said outlet pipe.

8. The apparatus as claimed in claim 1 wherein said hollow cup-like device is removably secured to said chamber.

* * * * *